US006149208A

United States Patent [19]

Jubinville

[11] Patent Number: 6,149,208

[45] Date of Patent: Nov. 21, 2000

[54] GATE CLOSURE FOR WIRE GATE

[76] Inventor: Leonard Arthur Jubinville, R.R. #2, St. Albert, Alberta, Canada, T8N 1M9

[21] Appl. No.: 09/351,705

[22] Filed: Jul. 12, 1999

[30] Foreign Application Priority Data

Jun. 18, 1999 [CA] Canada ..... 2275122

[51] Int. Cl.[7] ..... E05C 5/00

[52] U.S. Cl. ..... 292/66; 292/56; 292/7; 292/116

[58] Field of Search ..... 292/66, DIG. 13, 292/277, 109, 7, 8, 11, 116, 118, 97, 56, 29, 26, 52, 68

[56] References Cited

U.S. PATENT DOCUMENTS

| | | | |
|---|---|---|---|
| 139,712 | 6/1873 | Gillespie | 292/7 |
| 559,296 | 4/1896 | Lewis | 292/26 |
| 805,937 | 11/1905 | Snyder | 292/52 |
| 825,690 | 7/1906 | Young | 292/7 |
| 1,028,028 | 5/1912 | Kemp | 292/68 |
| 1,117,742 | 11/1914 | Woodard | 292/116 |
| 1,213,899 | 1/1917 | Petty | 292/66 |
| 1,429,389 | 9/1922 | Weintz | 292/DIG. 13 |
| 1,482,652 | 2/1924 | Klepper | 292/DIG. 13 |
| 2,593,545 | 4/1952 | DeBarbe | 292/26 |
| 2,904,101 | 9/1959 | Stephan | 292/26 |
| 3,844,594 | 10/1974 | Romberg | 292/66 |

OTHER PUBLICATIONS

Abstract of U.S. Patent No. 5,876,075, Barthelmess, Jr., Mar. 2, 1999, 2 pages.

Abstract and drawings of U.S. Patent No. 5,752,559, Minow, May. 19, 1998, 4 pages.

Abstract and drawings of U.S. Patent No. 5,476,133, Torkelson, Dec. 19, 1995, 4 pages.

Abstract of U.S. Patent No. 5,358,292, Van Wiebe, et al, Oct. 25, 1994, 2 pages.

Abstract of U.S. Patent No. 4,706,942, Robbins, Jr., Nov. 17, 1987, 1 page.

Abstract and drawings of U.S. Patent No. 4,683,934, Salsness, Aug. 4, 1987, 3 pages.

Abstract and drawings of U.S. Patent No. 4,371,200, Porter, Feb. 1, 1983, 3 pages.

Abstract and drawings of U.S. Patent No. 4,008,746, Romberg, Feb. 22, 1977, 3 pages.

Abstract of U.S. Patent No. 5,722,114, Lapp, Jr., et al, Mar. 3, 1998, 1 page.

Abstract of U.S. Patent No. 5,117,585, Andrisin, III, Jun. 2, 1992, 1 page.

Abstract of U.S. Patent No. 5,104,163, Palmer, Jr. et al., Apr. 14, 1992, 1 page.

Abstract of U.S. Patent No. 5,078,438, Bieganski, Jan. 7, 1992, 1 page.

Abstract of U.S. Patent No. 5,035,084, Towns, Jul. 30, 1991, 3 pages.

Abstract of U.S. Patent No. 4,371,200, Porter, Feb. 1, 1983, 2 pages.

*Primary Examiner*—Lynne H. Browne
*Assistant Examiner*—John B. Walsh
*Attorney, Agent, or Firm*—Christensen O'Connor Johnson Kindess PLLC

[57] ABSTRACT

A gate closure for a wire gate includes at least two gate engaging members in spaced relation. Levers are provided in spaced relation for each of the at least two gate engaging members. Each of the at least two gate engaging member is pivotally secured to one of the levers. A linkage is provided between the levers whereby the levers are operated in unison to move the at least two gate engaging members between a first position and a second position.

8 Claims, 8 Drawing Sheets

GATE CLOSURE FOR WIRE GATE

FIELD OF THE INVENTION

The present invention relates to a gate closure for a wire gate.

BACKGROUND OF THE INVENTION

For years barbed wire fences have being built using three or four strands of barbed wire which are strung between posts. In order to secure the gate to the fence structure, a gate post anchored in the ground was provided with a bottom loop and a top loop. In order to secure the gate in a closed position, a lower portion of a movable end member of the gate was inserted into the bottom loop. The top portion of the movable end member was then pushed into a position where it could be secured in position against the fixed gate post with the top loop. In order to make the task of positioning the top portion of the gate easier, a number of gate closure devices were developed. These gate closure devices were usually mounted to the gate post. The gate closure devices consisted of a movable gate engaging member that engaged the moveable end member and a lever that is used to pull the top of the movable end member of the gate toward the fixed gate post.

While the gate closures, as described above, have worked for years with barbed wire, they are not suited for other types of wire.

SUMMARY OF THE INVENTION

What is required is a gate closure for a wire gate that works with a variety of types of fencing wire.

According to the present invention there is provided a gate closure which includes at least two gate engaging members in spaced relation. Levers are provided in spaced relation for each of the at least two gate engaging members. Each of the at least two gate engaging member is pivotally secured to one of the levers. A linkage is provided between the levers whereby the levers are operated in unison to move the at least two gate engaging members between a first position and a second position.

The gate closure, as described above, is capable of being used with most types of wire fence. When a force is exerted upon the linkage, the levers move their respective gate engaging members. This results in the top portion of the movable end member of the gate and the bottom portion of the movable end member of the gate both are pulled into a locking position against the gate post to which the levers are mounted, usually by mounting brackets.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
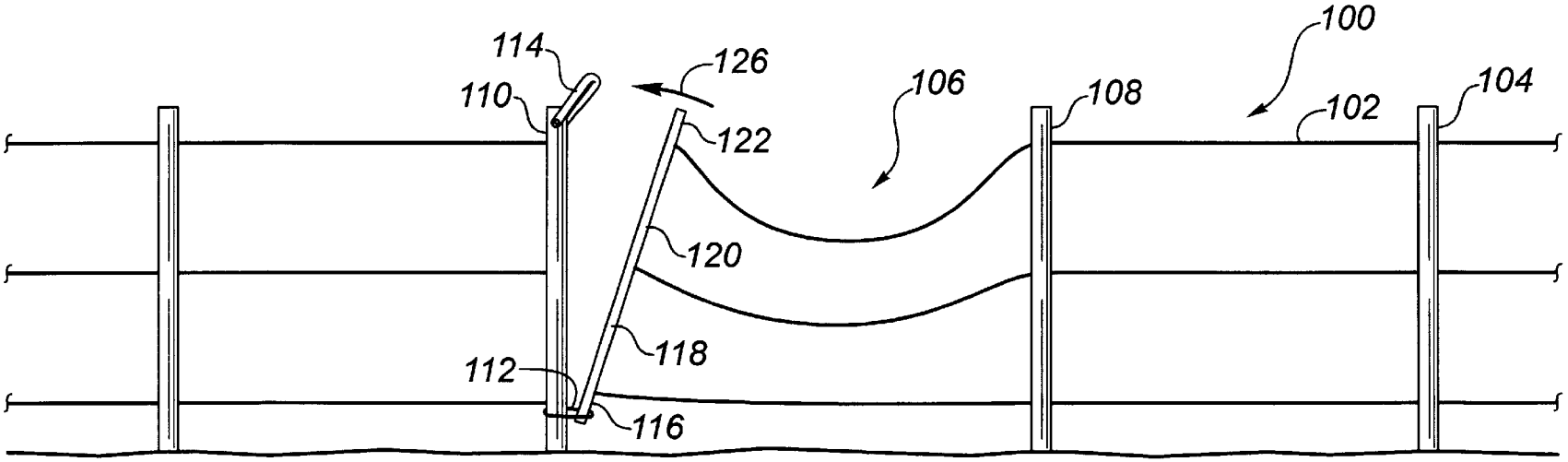
FIG. 1 (Prior Art)
FIG. 1 labelled as PRIOR ART is gate closure used with a barbed wire fence.

Two preferred embodiments of gate closure will now be described. Prior art will be described with reference to FIG. 1. A first embodiment generally identified by reference numeral 10, will be described with reference to FIGS. 2 through 5 and 8. A second embodiment generally identified by reference numeral 12 will be described with reference to FIGS. 6 and 7.

Referring to FIG. 1, a barb wire fence 100 comprises several strands of barbed wire 102 which are strung between posts 104. A gate 106 allows passage between a first fixed gate post 108 and a second fixed gate post 110. Both first fixed gate post 108 and second fixed gate post 110 are anchored in the ground. Normally, gate 106 is permanently secured to first fixed gate post 108 and is detachably securable to second fixed gate post 110. In the PRIOR ART, in order to secure gate 106 to the fence structure, second fixed gate post 110 is provided with a bottom loop 112 and a top loop 114. Gate 106 has a movable end member 118 at its free end 120. In order to secure gate 106 in a closed position, a lower portion 116 of movable end member post 118 at free end 120 of gate 106 is inserted into bottom loop 112. A top portion 122 of movable end member 118 is then pushed in a direction indicated by arrow 126 into a position where it is secured in position with top loop 114.

Figure 2:
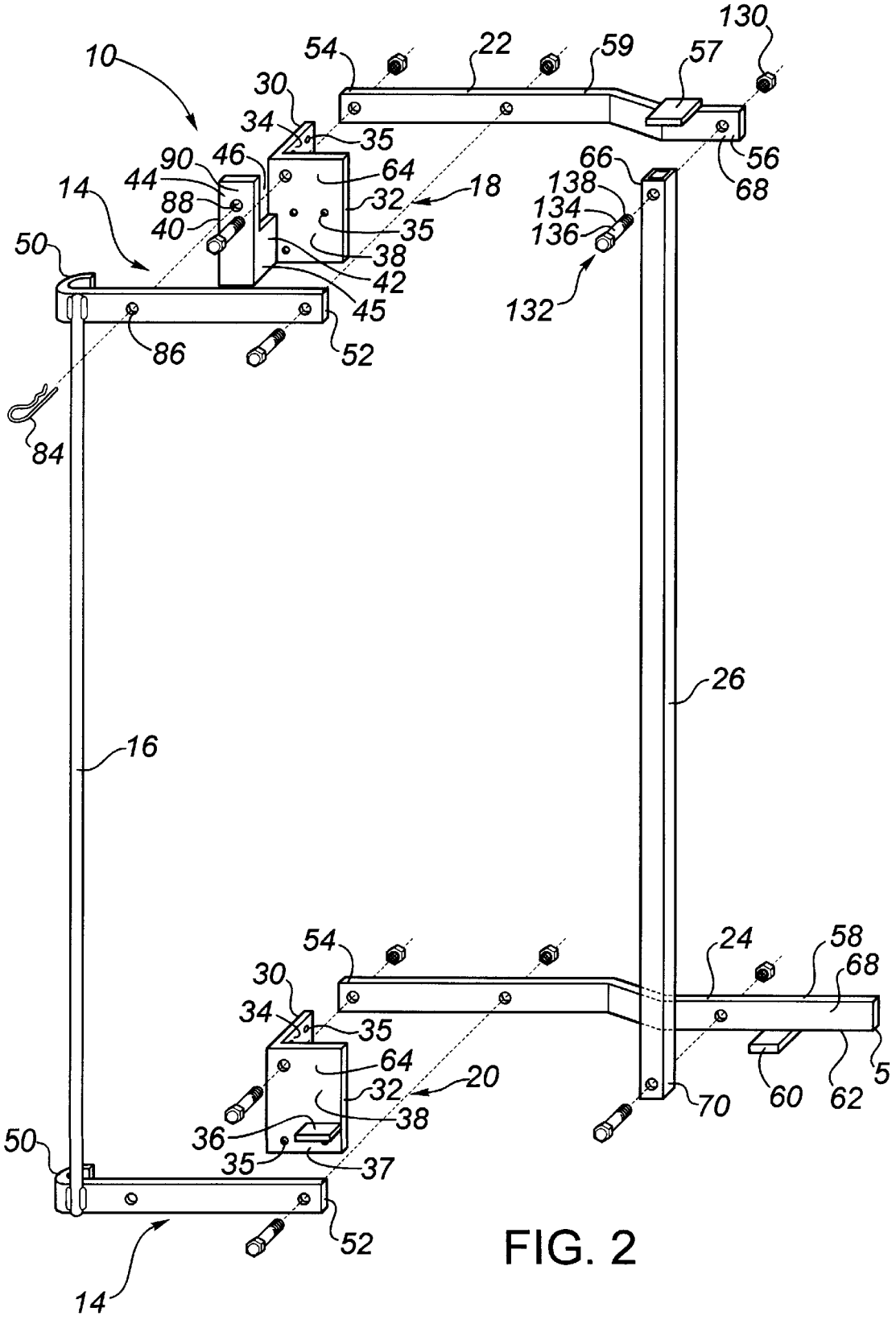
FIG. 2 is an exploded perspective view of a first embodiment of gate closure constructed in accordance with the teachings of the present invention.

Referring to FIG. 2, first embodiment of gate closure 10 comprises two gate engaging hook members 14 in spaced relation. A rigid reinforcing member 16 extends between gate engaging members 14 to maintain the spaced relation. A first post mounting bracket 18 and a second mounting bracket 20 are provided to enable gate closure 10 to be mounted to a gate post, as will hereinafter be further described. A first lever 22 is pivotally mounted to first post mounting bracket 18. A second lever 24 is pivotally mounted to second post mounting bracket 20. A linkage 26 extends between first lever 22 and second lever 24.

Figure 4:
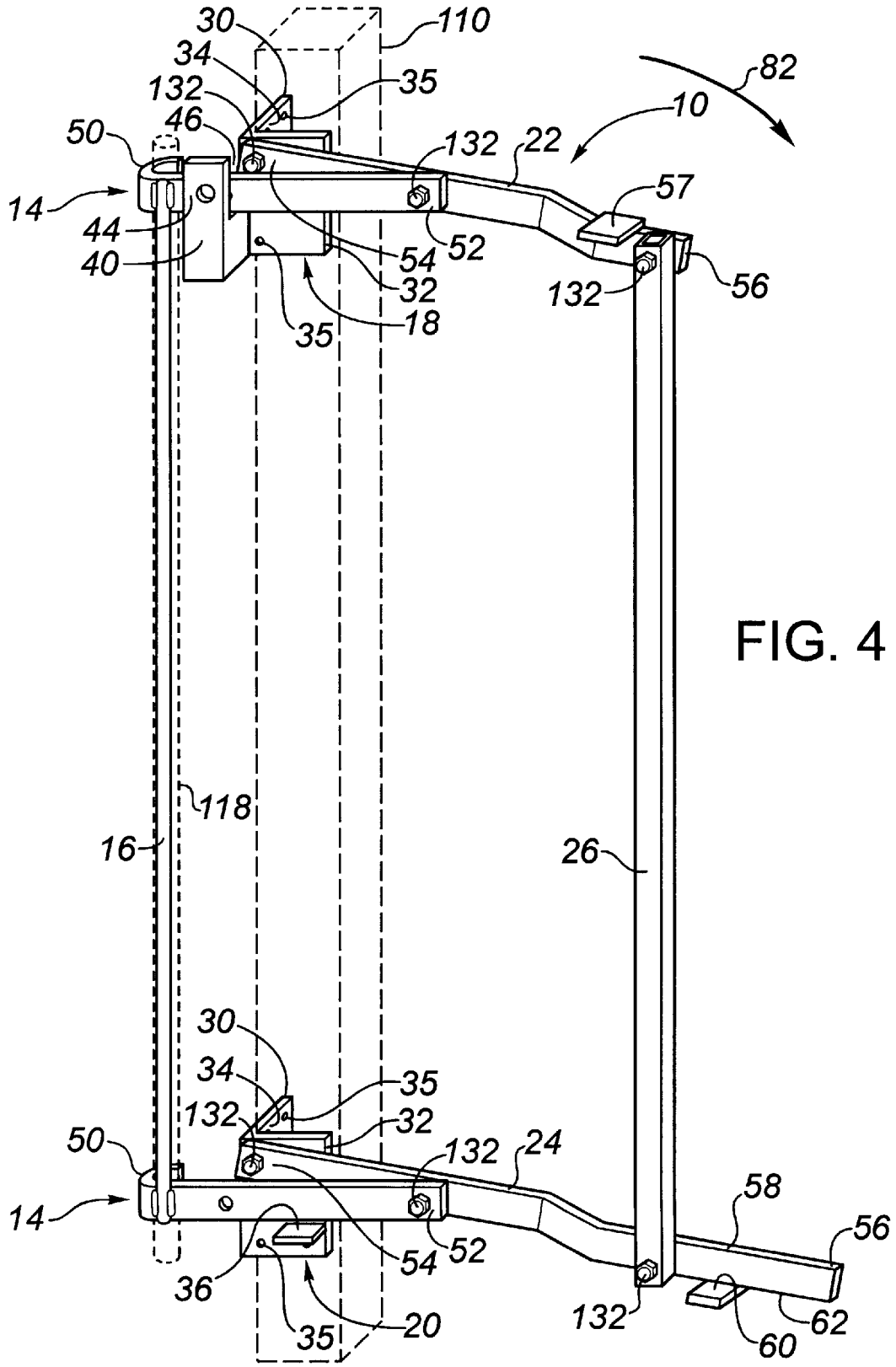
FIG. 4 is the gate closure as illustrated in FIG. 2 in a second or closed position.

Each of first mounting bracket 18 and second mounting bracket 20 has a first planar portion 30 and a second planar portion 32 rigidly affixed to first planar portion at approximately a 90 degree angle. This provides an outer surface 38 and an interior mounting surface 34 for mounting first and second mounting brackets 18, 20 to gate post 110, as illustrated in FIG. 4. Each of first mounting bracket 18 and second mounting bracket 20 is secured to second gate post 110 by means of nails or screws (not shown) driven through a plurality of receiving holes 35 in each of first portion 30 and second portion 32.

Referring to FIG. 2, a first lever stop 36 extends from a lower part 37 of outer surface 38 of second portion 32 of second mounting bracket 20. First portion 30 of first mounting bracket 18 has an extension 40 that extends past outer surface 38 of second portion 32. Extension 40 has a lateral member 42 and a vertical member 44 that extends from a remote end 45 of lateral member 42 in a direction away from and substantially parallel to second portion 32. A receiving channel 46 is formed between vertical member 44, second portion 32 and above lateral member 42 of first mounting bracket 18.

Each of gate engaging members 14 has a gate engaging end 50 and a pivot end 52. First lever 22 and second lever 24 each have a mounting end 54 and remote end 56. First lever 22 has a second lever stop 57 that extends perpendicularly from a top edge 59 at a position distanced from remote end 56 and in a direction away from second gate post 110 to which first mounting bracket 18 is to be secured. Second lever 24 has an extension 58 at remote end 56. A third lever stop 60 extends substantially perpendicularly from a bottom edge 62 of extension 58 of second lever 24 in a direction parallel to second lever stop 57 and away from gate post 110 to which second mounting bracket 20 is to be secured. First lever 22 is pivotally secured at mounting end 54 to an upper part 64 of second portion 32 of first mounting bracket 18. Second lever 24 is pivotally secured at mounting end 54 to upper part 64 of second portion 32 of second mounting bracket 20. A fulcrum for each of first lever 22 and second lever 24 is thereby established at each mounting end 54.

Figure 3:
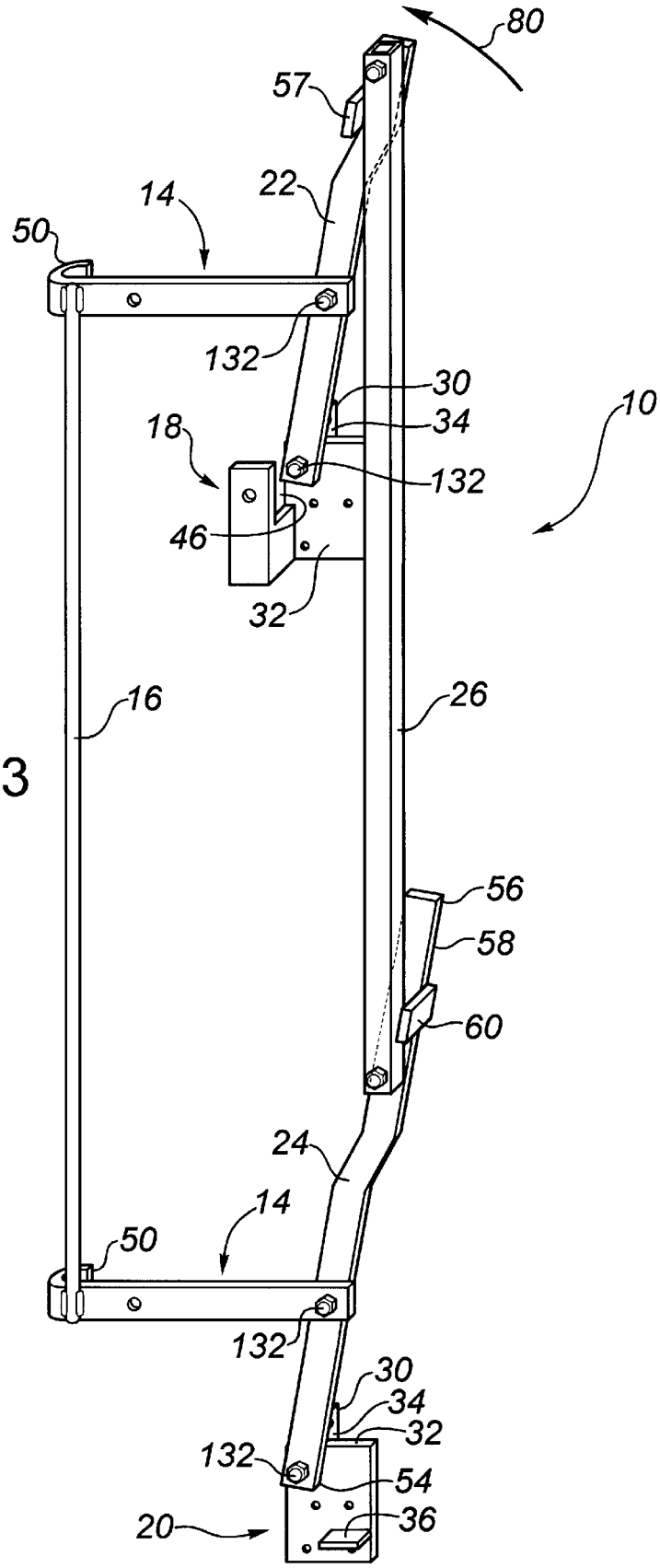
FIG. 3 is the gate closure as illustrated in FIG. 2 in a first or open position.
Figure 5:
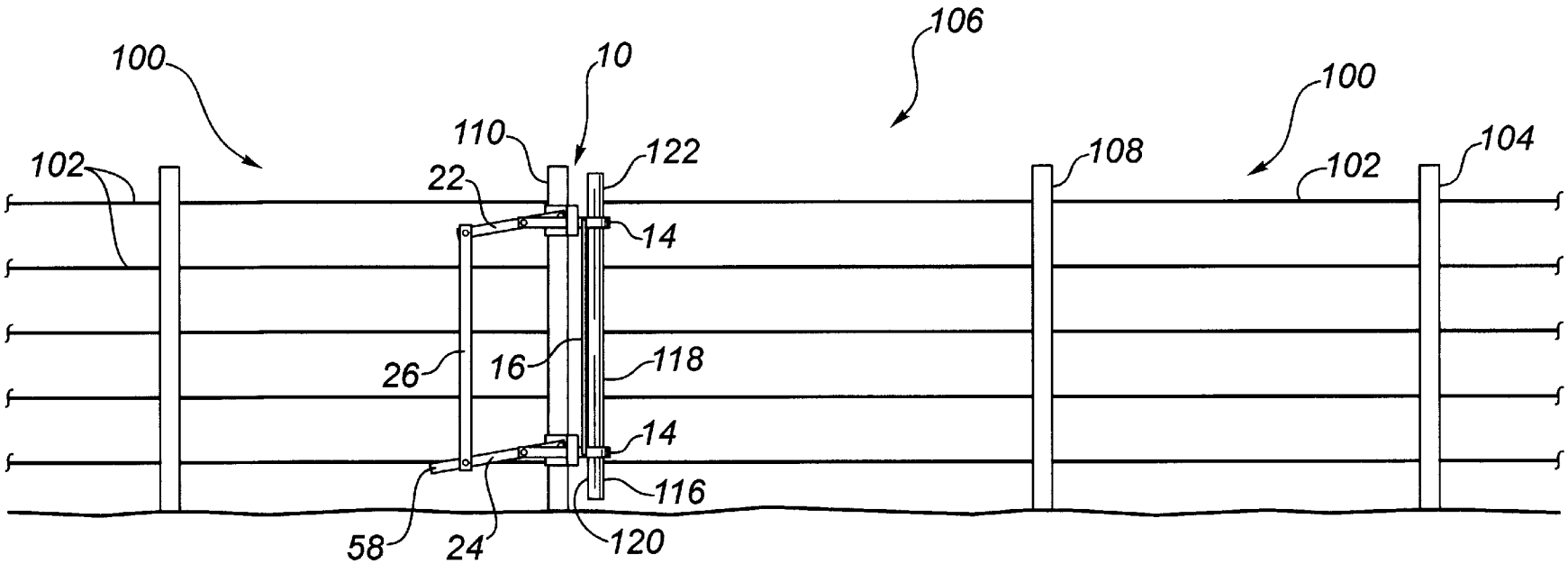
FIG. 5 is the gate closure as illustrated in FIG. 2 in a closed position on a wire fence.

Linkage 26 is pivotally secured at a first end 66 to a front face 68 at remote end 56 of first lever 22. Linkage 26 is pivotally secured to front face 68 of second lever 24 at a distance from mounting end 54 the same as a length of first lever 22. First lever 22 and second lever 24 are thereby constrained to move pivotally in unison in a plane parallel to second portion 32 of each of first mounting bracket 18 and second mounting bracket 20. Referring to FIGS. 3 and 4, the combination of first lever 22 and second lever 24 move pivotally between a first or open position illustrated in FIG. 3 and a second or closed position illustrated in FIG. 4. Referring to FIG. 3, when remote ends of both first lever 22 and second lever 24 are raised, as indicated by curved arrow 80, gate engaging ends 50 of each of gate engaging members 14 are distanced from the respective one of first mounting bracket 18 and second mounting bracket 20. When linkage 26 engages second lever stop 57 and third lever stop 60, combination of first lever 22 and second lever 24 are prevented from further movement in direction 80. Referring to FIG. 4, gate engaging ends 50 of gate engaging members 14 are hooked on to movable end member 118 of gate 106. Remote ends 56 of first lever 22 and second lever 24 are moved pivotally about the fulcrums at mounting ends 54 of each of levers 22, 24, as indicated by curved arrow 82. Gate engaging ends 50 of each of gate engaging members 14 are thereby each drawn toward the corresponding one of first mounting bracket 18 and second mounting bracket 20. When gate engaging member 14 secured to first lever 22 is positioned within receiving channel 46 and gate engaging member 14 secured to second lever 24 engages first lever stop 36, combination of first lever 22 and second lever 24 is prevented from further movement in direction 82. Referring to FIG. 5, movable end member 118 of gate 106 is drawn toward second gate post 110, thereby securely closing the gate.

Referring to FIG. 2, securing means, for example a cotter pin 84 or a padlock (not shown), is provided by which first embodiment of gate closure 10 can be secured in the second or closed position against inadvertent movement of first embodiment of gate closure 10 and consequent opening of the gate. A first passage 86 extends through gate engaging member 14 secured to first lever 22 at a position toward gate engaging end 54. A second passage 88 extends through a top part 90 of vertical member 44 of first mounting bracket 18. Referring to FIG. 4, when first embodiment of gate closure 10 is in the second position, first passage 86 and second passage 88 are aligned and securing means can be inserted therethrough.

Referring to FIG. 2, each means for pivotally securing one component to another component of either first gate closure 10 or second embodiment of gate closure 12 comprises a nut 130 and a bolt 132, and any washers or spacers as may be required to securely position said nut 130 and bolt 132. A shaft 134 of bolt 132 has a smooth surfaced head end 136, thereby allowing rotation of a body about shaft 134, and a threaded remote end 138 to receive nut 130.

Figure 8:
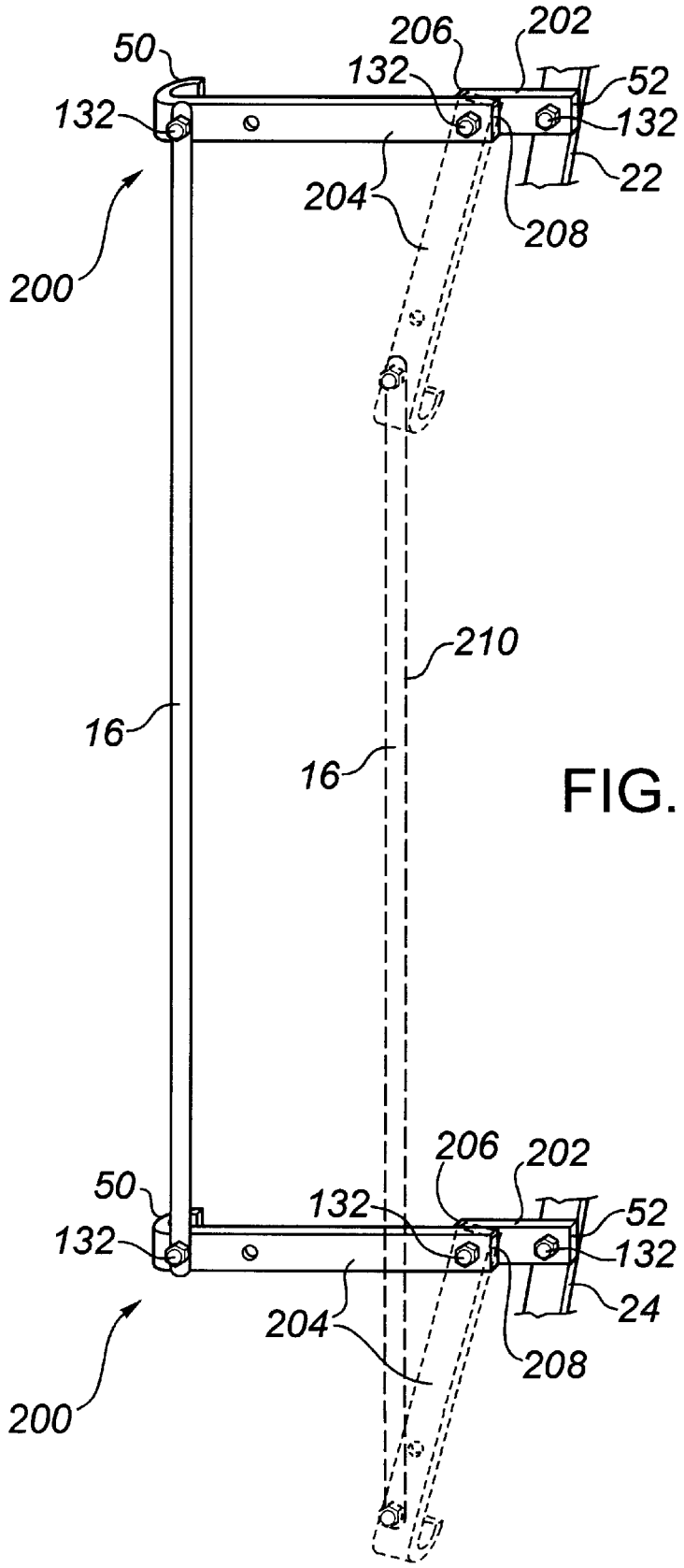
FIG. 8 is a perspective view of a modified version of the gate closure illustrated in FIG. 2.

Referring to FIG. 5, when it is necessary to maximize a width of the passage between first fixed gate post 108 and second fixed gate post 110, it becomes necessary that gate closure 10 in the open position illustrated in FIG. 3 does not encroach into said passage. FIG. 8 illustrates a modified version of the gate closure illustrated in FIG. 2, with modified gate engaging members which are generally identified by reference numeral 200. The modification is intended to enable a user to move gate engaging ends 50 out of the passage of the open gateway. Gate engaging members 200 have a first portion 202 and a second portion 204. First portion 202 of one of gate engaging members is pivotally secured to first lever 22 and first portion 202 of the other of gate engaging members 200 is pivotally secured to second lever 24, in a similar manner to gate engaging members 14 as illustrated in FIG. 3. Second portion 204 of each of alternative embodiments of gate engaging members 200 is pivotally secured at a pivot end 208 to a remote end 206 of first portion 202. Reinforcing member 16 is pivotally secured at each end of reinforcing member 16 to second portion 204 of each of gate engaging members 200 so that second portions 204 maintains the spaced relation and can be moved in concert. When gate closure 10 with gate engaging members 200 is in the open position, gate engaging end 50 is disengaged from the gate. Second portion 204 of each of second embodiment of gate engaging members is then free to be moved to a position indicated by dashed lines 210 in which gate engaging ends 50 pivot by force of gravity into a position that does not impinge upon the passage of the gateway.

Figure 6:
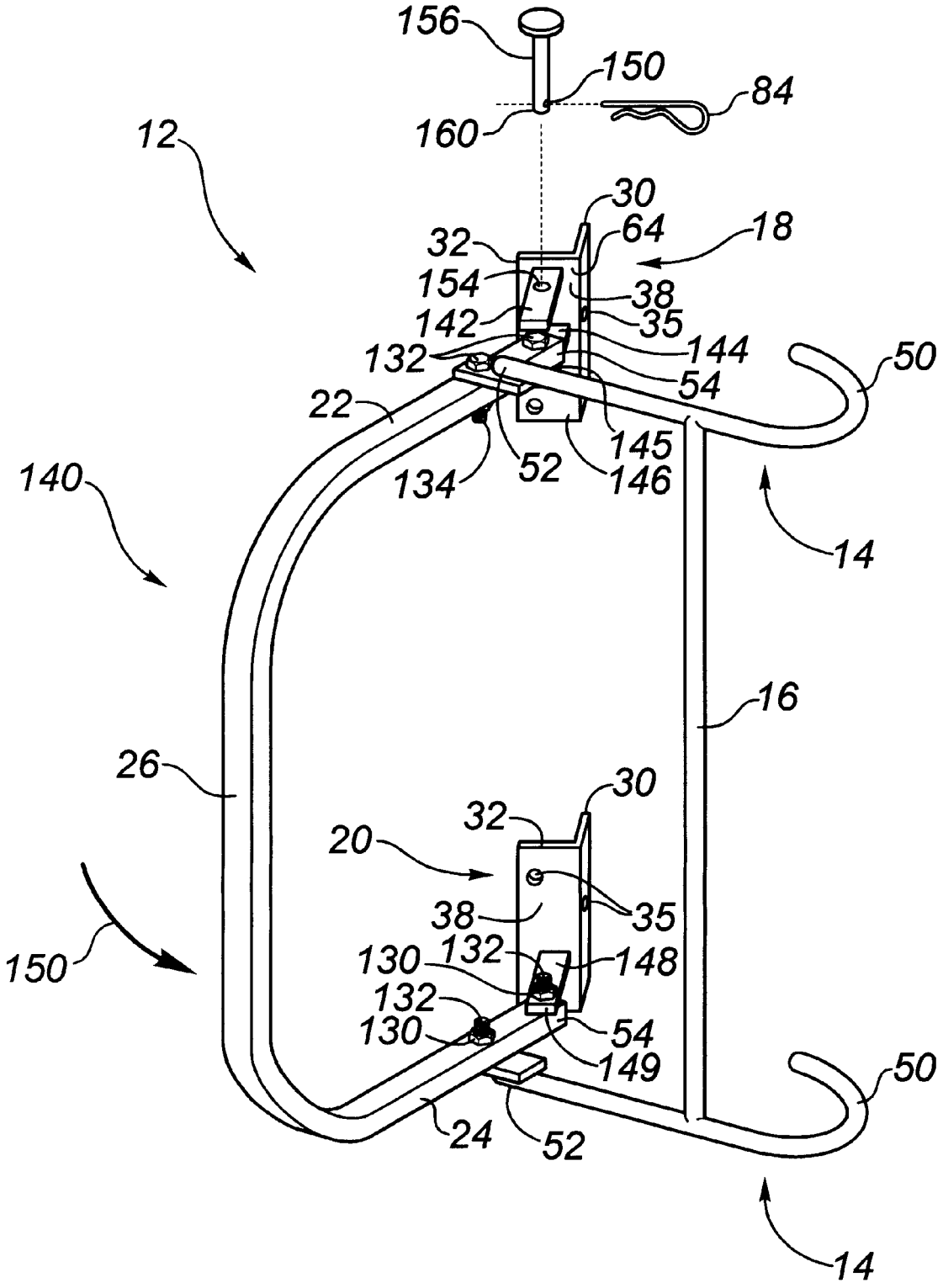
FIG. 6 is a perspective view of a second embodiment of gate closure constructed in accordance with the teachings of the present invention in a first or open position.

Referring to FIG. 6, second embodiment of gate closure 12 is similar to first embodiment 10 in that second embodiment includes two gate engaging hook members 14 in spaced relation and rigid reinforcing member 16 extending between gate engaging members 14, thereby maintaining the spaced relation, a first gate post mounting bracket 18 and a second gate post mounting bracket 20. In the embodiment illustrated in FIGS. 6 and 7, first lever 22, second lever 24, and linkage 26 are constructed from a single piece of shaped box beam 140. It will be recognized that a component structure would serve in place of shaped box beam 140. Second embodiment 12 differs from first embodiment 12 in the method of pivotally mounting first lever 22 to first mounting bracket 18 and mounting second lever 24 to second mounting bracket 20. First mounting bracket 18 has a first mounting tab 142 extending substantially horizontally from outer surface 38 at upper part 64 and a second mounting tab 144 extending substantially horizontally at, lower part 144 of second portion 32. Second mounting bracket 20 has a third mounting tab 148 extending substantially horizontally from a central position of outer surface 38 of second portion 32. First lever 22 is pivotally mounted at its fulcrum at mounting end 54 to a remote end 145 of second mounting tab 144. Second lever 24 is pivotally mounted at its fulcrum at mounting end 54 to a remote end 149 of third mounting tab 148. Each of gate engaging members 14 is pivotally secured at pivot end 52 to one of first lever 22 or second lever 24. The combination of first lever 22, second lever 24 and linkage 26 moves pivotally about the fulcrums at mounting ends 54 such that first lever 22, second lever 24, and gate engaging members 14 each moves pivotally on a plane perpendicular to second gate post 110 upon which first mounting bracket 18 and second mounting bracket 20 are mounted as illustrated in FIG. 7.

Figure 7:
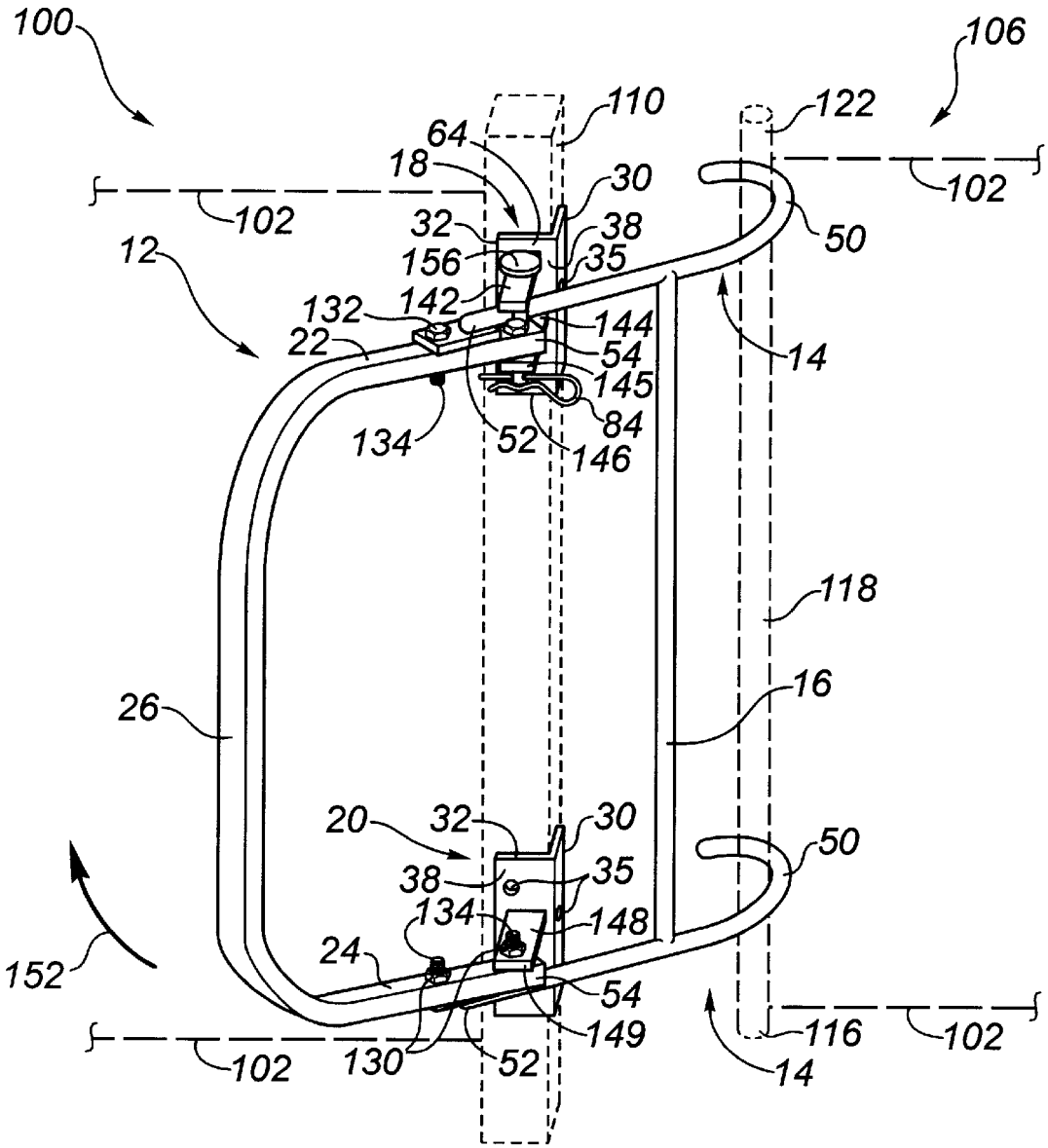
FIG. 7 is the gate closure as illustrated in FIG. 6 in a second or closed position.

Second embodiment 12 is movable between a first or open position illustrated in FIG. 6 and a second or closed position illustrated in FIG. 7. Referring to FIG. 6, when linkage 26 is moved horizontally in a direction away from a fence to which second embodiment 12 is secured, as indicated by curved arrow 150, gate engaging ends 50 of gate engaging members 14 each are moved away from first mounting bracket 18 and second mounting bracket 20. Referring to FIG. 7, movable end member 118 of gate 106 is engaged by gate engaging ends 50 of gate engaging members 14. When linkage 26 is moved horizontally toward fence 100, as indicated by curved arrow 152, gate engaging ends 50 are drawn toward second gate post 110, thereby closing gate 106. Vertically aligned holes 154 are in each of first mounting tab 142 and second mounting tab 144. When second embodiment 12 is in the second or closed position, gate engaging member 14 secured to first lever 22 lies between holes 154 and first mounting bracket 18 and pivot end 54 of first lever 22 lies between holes 154 and remote end 145 of second mounting tab 144. Second embodiment 12 is secured from inadvertent opening by inserting a securing pin 156 through holes 154, as illustrated in FIG. 7. Securing pin 156 is thereby vertically inserted between first lever 22 and gate engaging member 14 secured to first lever 22, preventing horizontal movement of said gate engaging member 14. If desired, securing pin 156 can be further secured in place by inserting cotter pin 84 through a hole 158 at a remote end 160 of securing pin 156, illustrated in FIG. 6.

It will be apparent to one skilled in the art that modifications may be made to the illustrated embodiment without departing from the spirit and scope of the invention as hereinafter defined in the Claims.

THE EMBODIMENTS OF THE INVENTION IN WHICH AN EXCLUSIVE PROPERTY OR PRIVILEGE IS CLAIMED ARE DEFINED AS FOLLOWS:

1. A gate closure, comprising:

at least two gate engaging members in spaced relation;

levers in spaced relation for each of the at least two gate engaging members, each of the levers having a mounting end and a remote end, each of the at least two gate engaging members being pivotally secured to one of the levers in an intermediate position between the mounting end and the remote end;

the mounting end of each of the levers being adapted to be pivotally secured to a post; and a linkage between the levers positioned toward the remote end of each of the levers whereby the levers are operated in unison to move the at least two gate engaging members between a first position and a second position.

2. The gate closure as defined in claim 1, wherein the at least two gate engaging members are hooks.

3. The gate closure as defined in claim 1, wherein a rigid reinforcing member extends between the at least two gate engaging members.

4. The gate closure as defined in claim 1, wherein the mounting end of each of the levers is pivotally mounted to a post mounting bracket.

5. A gate closure, comprising:

at least two gate engaging members in spaced relation;

a rigid reinforcing member extending between the gate engaging members, thereby maintaining the spaced relation;

at least two post mounting brackets;

levers for each of the gate engaging members, each of the levers having a mounting end and a remote end, each of the gate engaging members being pivotally secured to one of the levers in an intermediate position between the mounting end and the remote end, the mounting end of each of the levers being pivotally mounted to one of the at least two post mounting brackets; and a linkage between the levers positioned toward the remote end of each of the levers whereby the levers are operated in unison to move the gate engaging members between a first position and a second position.

6. The gate closure as defined in claim 5, wherein the at least two gate engaging members are hooks.

7. The gate closure as defined in claim 5, wherein each of the post mounting brackets has a mounting surface, each of the levers being pivotally secured to the mounting surface of one of the post mounting brackets for pivotal movement on a plane parallel to the mounting surface.

8. A gate closure, comprising:

two gate engaging hook members in spaced relation;

a rigid reinforcing member extending between the gate engaging members, thereby maintaining the spaced relation;

two post mounting brackets, each of the post mounting brackets having a mounting surface;

levers for each of the gate engaging members, each of the levers having a mounting end and a remote end, each of the post engaging members being pivotally secured to one of the levers in an intermediate position between the mounting end and the remote end, the mounting end of each of the levers being pivotally mounted to the mounting surface of one of the post mounting brackets for pivotal movement on a plane parallel to the mounting surface; and a linkage between the levers positioned toward the remote end of each of the levers whereby the levers are operated in unison to move the gate engaging members between a first position and a second position.

* * * * *